United States Patent [19]

Morris

[11] Patent Number: 4,619,232

[45] Date of Patent: Oct. 28, 1986

[54] INTERACTIVE IDLE SPEED CONTROL WITH A DIRECT FUEL CONTROL

[75] Inventor: Robert L. Morris, Plymouth, Mich.

[73] Assignee: Ford Motor Company, Dearborn, Mich.

[21] Appl. No.: 730,912

[22] Filed: May 6, 1985

[51] Int. Cl.[4] ..... F02D 41/16; F02D 43/00

[52] U.S. Cl. ..... 123/339; 123/344; 123/352; 123/418

[58] Field of Search ..... 123/339, 352, 418, 344

[56] References Cited

U.S. PATENT DOCUMENTS

| | | | |
|---|---|---|---|
| 4,047,507 | 9/1977 | Noguchi et al. | 123/344 |
| 4,142,483 | 3/1979 | Ironside | 123/486 |
| 4,262,643 | 4/1981 | Cavil et al. | 123/416 |
| 4,328,775 | 5/1982 | Ironside | 123/339 |
| 4,338,899 | 7/1982 | Geiger et al. | 123/339 |
| 4,344,397 | 8/1982 | Geiger et al. | 123/339 |
| 4,389,989 | 6/1983 | Hartig | 123/339 |

*Primary Examiner*—Andrew M. Dolinar

*Attorney, Agent, or Firm*—Peter Abolins; Robert D. Sanborn

[57] ABSTRACT

A method for controlling the idling speed of an internal combustion engine supplied with a lean air/fuel ratio includes generating a speed error signal. The speed error signal is used to generate a fuel pulse width command signal to control fuel mass charge as a function of the speed error signal. A throttle command signal is generated as a function of the fuel mass charge to maintain a desired air mass charge which in turn maintains a desired air to fuel ratio.

10 Claims, 7 Drawing Figures

INTERACTIVE IDLE SPEED CONTROL WITH A DIRECT FUEL CONTROL

This patent application relates to copending, commonly assigned, patent applications Ser. No. 718,619, now U.S. Pat. No. 4,572,127, entitled "Interactive Spark and Throttle Idle Speed Control" and Ser. No. 747,042, entitled "Interactive Idle Speed Control with Direct Air Control".

BACKGROUND OF THE INVENTION

1. Field of the Invention

This invention relates to interactive idle speed control for an internal combustion engine using air control and fuel control 2. Prior Art Various idle speed control systems for internal combustion engines are known. Such systems include some which are primarily mechanical and some which are primarily electronic. One of the goals such systems have tried to achieve is to provide increased engine idling stability. However, attempts to react rapidly to changing conditions in order to achieve idling stability may cause an overshoot of desired idling speed or other instability.

U.S. Pat. No. 4,328,775 issued to Ironside teaches a closed loop idling control for an internal combustion engine including a difference signal generator which produces an engine speed error signal. This signal passes through a phase compensator and directly controls the ignition timing to provide a fast loop control of speed. Additionally, the engine speed error signal controls the throttle position through an integrator in a series connection with the phase compensator to provide a slow loop which cancels out the engine speed error to avoid increased exhaust contamination.

U.S. Pat. No. 4,338,899 issued to Geiger et al teaches controlling the ignition timing of a spark ignited internal combustion engine charged with a lean air-fuel ratio to have a stabilized idle speed which is approximately equal to a desired idle speed. The ignition timing of the engine is controlled to linearly advance the timing from a nominal retarded condition in proportion to a change in engine speed below the desired speed. The timing advance may be implemented via a constant time delay and has the same ratio to engine speed changes as the ratio of nominal ignition pulse spacing to the desired engine idle speed U.S. Pat. No. 4,344,397 issued to Geiger et al teaches stabilizing engine idle speed by a successive three-stage control system which sequentially regulates ignition timing, fuel quantity and air throughput volume.

U.S. Pat. No. 4,142,483 issued to Ironside teaches an internal combustion engine operation timing control using a programmed read-only memory to produce a multibit digital signal used to determine the instant of operation. One input to the ROM is from a speed counter and the other input to the ROM is from another engine parameter transducer. The digital output of the ROM is applied to a timing counter. A master clock is used for clocking both the speed counter and the timing counter.

U.S. Pat. No. 4,262,643 issued to Cavil et al teaches a timing control system for an internal combustion engine producing a cyclical control pulse. offset from a cyclical engine timing reference pulse The processing circuit includes a counter connected to a NAND gate for producing a control pulse when the counter reaches a preset count, a monostable device subject to the control pulse for resetting the counter, an oscillator for providing preload pulses to the counter for a predetermined period of time to establish a preload count, and a phase-locked loop subject to the reference pulse for transmitting a fixed number of signal pulses per engine revolution to the counter to increment the preload count until the preset count is reached, whereby the control pulse is produced.

U.S. Pat. No. 4,389,989 issued to Hartig teaches an electronic arrangement for idling stabilization between a signal transmitter for ignition spark formation and an ignition device for internal combustion engines. When engine rotational speed decreases, the ignition time point is advanced below a first engine rotational speed, in which there presently is retarded a pulse obtained from the signal transmitter and, with regard to the contemplated unretarded pulse sequence, is transmitted as an advanced signal to the ignition device whereby the unretarded pulses are emitted externally of the stabilization range intermediate the first and a second lower engine rotational speed.

There still remains a need for improved regulation of engine idle speed. In particular, it would be desirable to have faster response to idle speed fluctuations by control of both fuel pulse width and engine air intake volume.

SUMMARY OF THE INVENTION

This invention includes a method of controlling the idling speed of an internal combustion engine supplied with a lean air/fuel ratio. The air/fuel ratio is in a range wherein an increased air/fuel ratio corresponds to decreased torque. The method includes generating a speed error as the difference between a desired engine idle speed and the actual engine idle speed. A fuel pulse width command signal is generated as a function of the time integral of the speed error as well as the phase compensated speed error to control the fuel mass charge. A throttle command signal is generated as a function of the fuel charge and speed error so as to maintain a desired air mass charge which in turn maintains a desired air to fuel ratio. Spark advance increases linearly as speed decreases below the desired speed.

In accordance with this invention, there is direct fuel control and the air control follows the fuel control. Advantageously, engine operation is lean of stoichiometry and the engine's torque is limited by the amount of fuel. Thus, the primary control loop is provided using fuel pulse width with the control of the amount of air tracking the fuel control. Air and fuel may be controlled simultaneously during engine speed perturbations. However, under steady state conditions, the air mass charge tracks the fuel pulse width. This minimizes control system delays and enhances engine idle stability. Also, the spark advances from a retarded condition as engine speed drops below a set point to provide a fast acting inner control loop and further enhance idle stability.

DETAILED DESCRIPTION OF THE INVENTION

Figure 1:
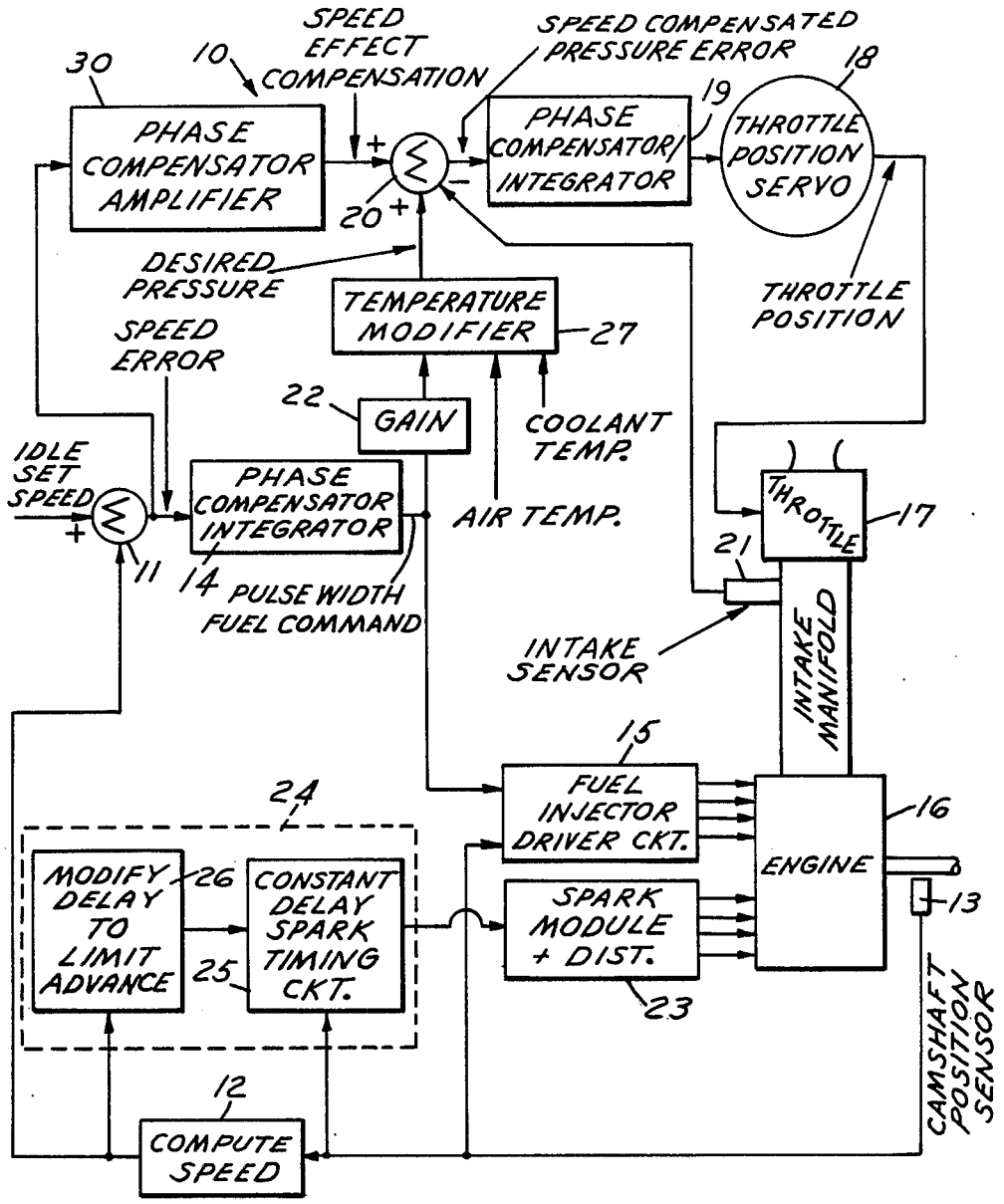
FIG. 1 is a block diagram of an interactive idle speed control method in accordance with an embodiment of this invention.

Referring to FIG. 1, an idle speed control system 10 includes a summer 11 receiving an input for a desired idle speed set point and an input for actual idle speed from a speed computer 12 which receives a signal from a crankshaft position sensor 13. The output of summer 11 is a speed error signal applied to a phase compensator/integrator 14 which then applies a fuel pulse width signal to a fuel injector driver circuit 15 which in turn provides fuel injection to engine 16. As is known in feedback systems, phase compensation is used to compensate for signal delay due to the time of signal propagation through a system.

Figure 1A:
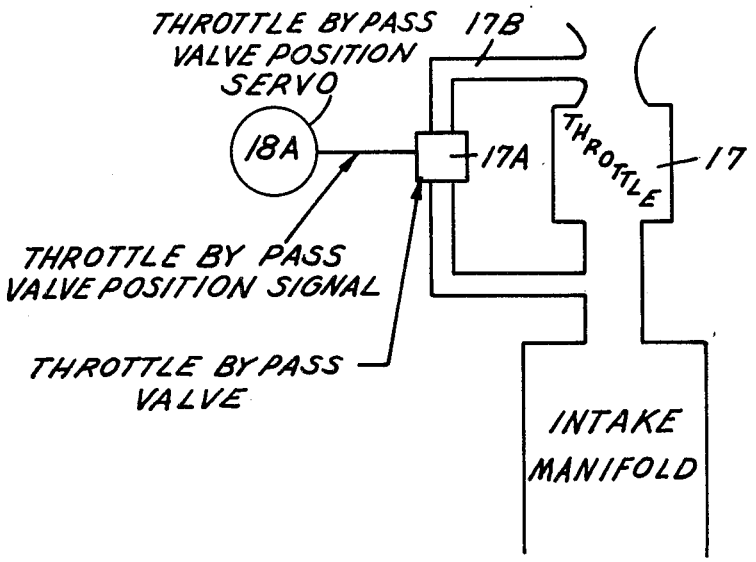
FIG. 1A is a portion of the block diagram of FIG. 1 including modified elements for an embodiment controlling airflow in a bypass valve around the throttle of an internal combustion engine.

Engine 16 receives intake manifold air through a throttle 17 which has its throttle position adjusted by throttle position servo 18 which receives a signal from a phase compensator/integrator circuit 19. Referring to FIG. 1A, a modification of the throttle command signal is used to control the air flow in a bypass valve 17A around throttle 17. Bypass valve 17A is positioned in a throttle bypass path 17B and receives a throttle bypass valve position signal from a throttle bypass valve position servo 18A. The input to phase compensator/integrator circuit 19 comes from a summer 20 which receives one input from an intake sensor 21 indicating actual engine manifold pressure, or measuring intake air flow volume, one input from a phase compensator/amplifier 30, and one input from phase compensator/integrator 14 through a gain amplifier 22 and a temperature modifier 27, which provides a desired manifold input pressure. As a result, the output of summer 20 is a speed compensated pressure error signal. When there is no engine speed change, the speed effect compensation signal applied to summer 20 by phase compensator/amplifier 30 is zero. In such a case, the speed compensated pressure error output signal of summer 20 is equal to the difference between the desired and actual manifold pressure. As a result, the input to summer 20 from phase compensator/amplifier 30 modifies a pressure error generated by summer 20. Also, if a simpler system is desired, phase compensator/amplifier 30 can be eliminated and the speed error can be used directly to compensate the pressure error.

Engine 16 also has an applied spark from a spark module and distributor 23. The input to spark module 23 is from a spark advance circuit 24. In one embodiment, spark advance circuit 24 includes a constant delay spark timing circuit 25 which receives an input from a delay circuit 26 and crankshaft position sensor 13. Delay circuit 26 receives an input from the output of speed computation circuit 12. Thus, spark advance circuit 24 provides a constant spark delay. With a constant spark delay with respect to the previously fired cylinder, changes in engine RPM cause an effective change in the spark timing advance with respect to the next to fire cylinder. A spark ignition will be produced at a nominal advance when the engine speed equals an idle set speed. When the engine speed drops below the idle set speed, the time between top dead center events increases and with a constant delay count, the spark advance will increase As the engine speed increases above the idle set speed, the time between top dead center events decreases and, with a constant delay count, the spark advance will decrease. Thus, the spark advance is corrected in proportion to the speed error without any calculations.

Alternatively, if desired, spark advance circuit 24 can include the calculation means for calculating the desired spark timing based upon engine speed and desired spark angle, where the desired spark angle is based upon the speed error.

This can be accomplished by first calculating the crankshaft speed as $$N=180/T,$$

wherein N is the speed in deg/sec and T is the time measured between top dead center (TDC) events (there are 180 degrees between TDC's on four cylinder engines). Next, the crank angle delay after TDC for firing the spark is determined by $$\theta D=180-\theta A,$$

wherein $\theta D$ is the delay angle after TDC and $\theta A$ is the desired spark advance angle before TDC. Finally, the delay angle is converted into a delay time after TDC (assuming that the crankshaft speed for the next TDC period will remain unchanged) by $$TD=\theta D/N,$$

wherein TD is the delay time. The above scheme is based on crankshaft position information available every 180 degrees from a magnetic pickup. If the scheme found in production strategies uses crankshaft information available every 90 degrees from a Hall effect distributor, the number 180 in the above equations simply changes to 90 and the delay time is referenced to 90 degrees after TDC. Another variation found in production strategies is to calculate the rate of change in speed from one 90 degree period to the next to get a better prediction for the correct delay time over the following period during transient conditions.

In operation, the apparatus of FIG. 1 interactively controls engine air mass charge, fuel mass charge and spark advance to maintain stable operation about an idle set speed. Spark advance and fuel pulse width are used to control engine torque. The spark advance varies in proportion to the speed error and the fuel pulse width varies in proportion to the phase compensated speed error and its time integral to return the engine to its idle set speed. The engine air mass charge is then controlled to follow the fuel mass charge to maintain a desired air fuel ratio. This is accomplished by controlling the throttle position in such a way that the manifold pressure will track a desired manifold pressure, which is in proportion to the fuel pulse width and other variables.

As a result, an engine's torque is fuel limited and the primary control loop is on fuel pulse width with the air mass charge control tracking the fuel control. This enhances engine idle stability due to a reduced control system delay.

Figure 2:
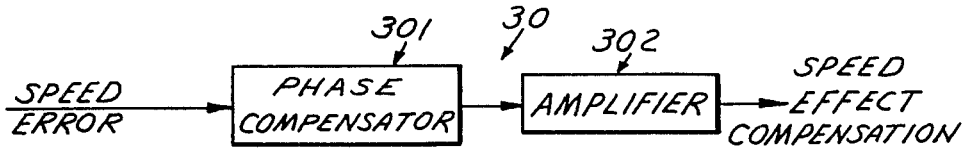
FIG. 2 is a more detailed block diagram of phase compensator/amplifier 30 of FIG. 1.

Referring to FIG. 2, a more detailed depiction of phase compensator/amplifier 30 includes a phase compensator 301 which receives the speed error as an input and applies an output to an amplifier 302. The output of amplifier 302 is the speed effect compensation which is applied to summer 20 of FIG. 1.

Figure 3:
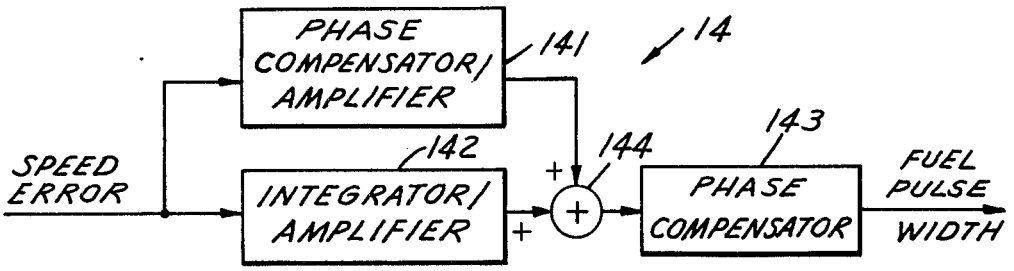
FIG. 3 is a more detailed block diagram of compensator/integrator 14 of FIG. 1.

Referring to FIG. 3, a more detailed breakdown of phase compensator/integrator 14 includes the speed error being applied to the parallel combination of a phase compensator/amplifier 141 and integrator/amplifier 142 whose outputs are both applied to a summer 144. The output of summer 144 is applied to the input of a phase compensator 143 which has as an output the fuel pulse width.

Figure 4:
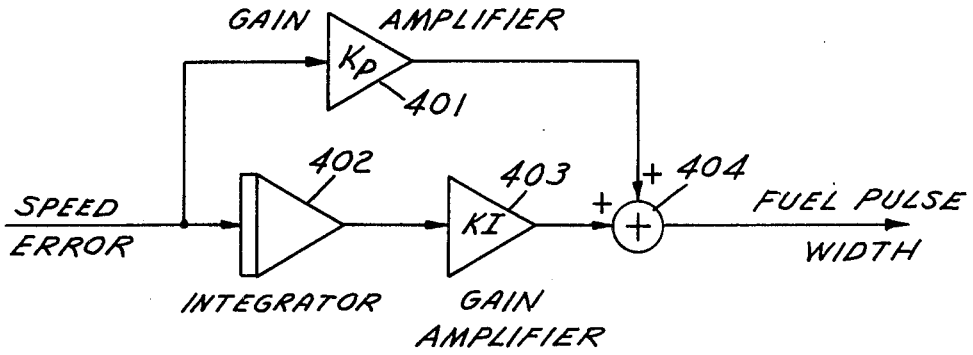
FIG. 4 is a block diagram of a particular embodiment of FIG. 3.

Referring to FIG. 4, the particular implementation of phase compensator/integrator block 14 uses proportional and integration functions and omits the phase compensators. In particular, a speed error is applied to the input of a gain amplifier 401 and to the input of the series combination of an integrator 402 and a gain amplifier 403 which series combination is in parallel with gain amplifier 401. The outputs of gain amplifier 401 and gain amplifier 403 are both applied to a summer 404. The output of summer 404 is a fuel pulse width signal.

Figure 5:
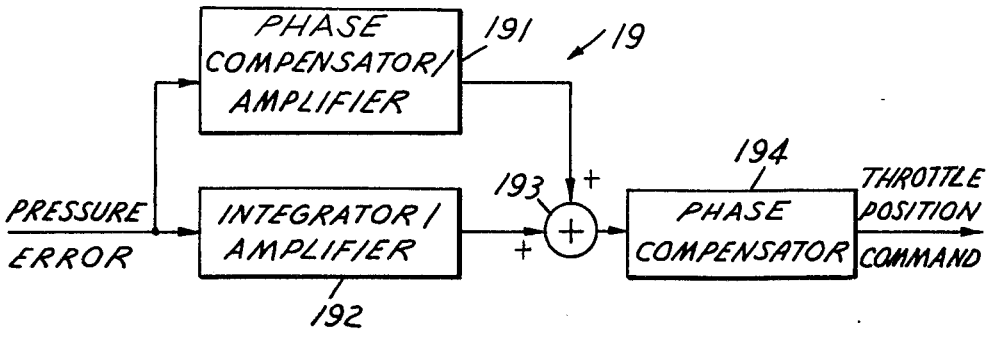
FIG. 5 is a more detailed block diagram of compensator/integrator 19 of FIG. 1.

Referring to FIG. 5, a more detailed depiction of phase compensator/integrator 19 includes the pressure error signal being applied to the parallel combination of a phase compensator/amplifier 191 and an integrator/amplifier 192. The outputs of phase compensator/amplifier 191 and integrator/amplifier 192 are both applied to a summer 193. The output of summer 193 is applied to the input of a phase compensator 194 which has as an output the throttle position command signal.

Figure 6:
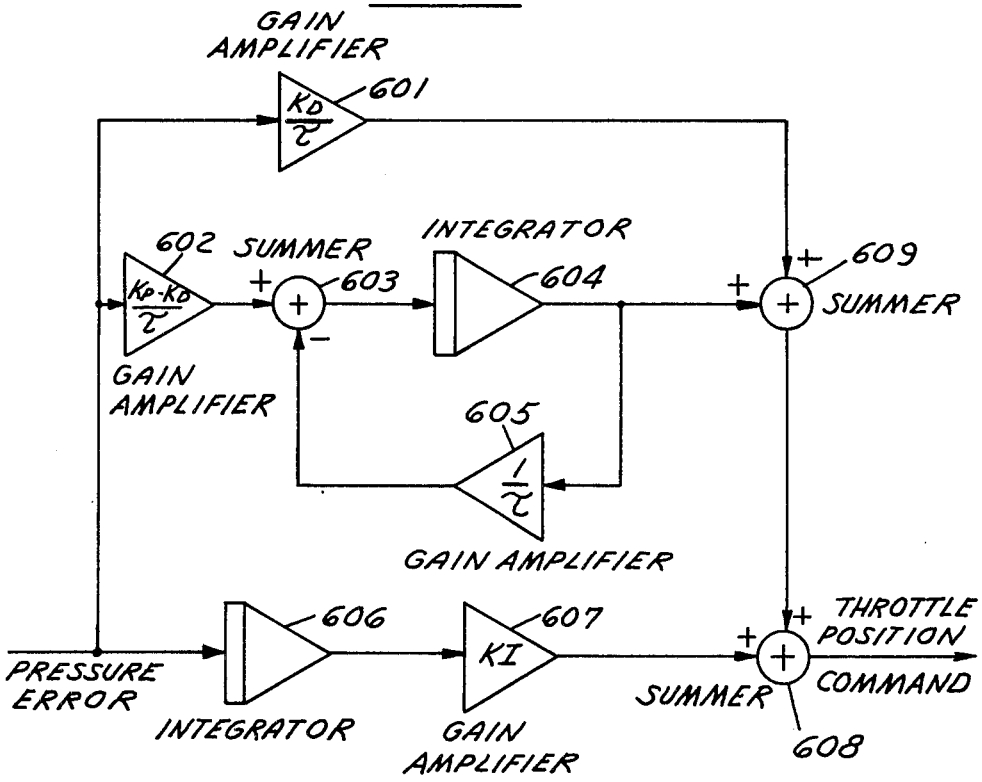
FIG. 6 is a block diagram of an embodiment of FIG. 5.

Referring to FIG. 6, a particular implementation of the phase compensator/integrator 19 shown in FIG. 5 uses a proportional, integral and derivative transfer function with the second phase compensation being omitted. That is, a pressure error signal is applied to a gain amplifier 601, a gain amplifier 602 and an integrator 606. The output of gain amplifier 601 is applied to a summer 609. The output of gain amplifier 602 is applied to a summer 603 which has an output applied to integrator 604 which has an output applied to summer 609. A feedback loop around integrator 604 includes a gain amplifier 605 having an input coupled to the output of integrator 604 and having an output applied to summer 603. The output of integrator 606 is applied to the input of a gain amplifier 607 which has an output applied to a summer 608. Another input to summer 608 is the output of summer 609. The output of summer 608 is a throttle position command. The action of the circuit of FIG. 6 approximates the following equation:

$$\text{Throttle Position Command} = Kp \times \text{Pressure Error} + KD \times \text{Time Derivative of Pressure Error} + KI \times \text{Time Integral of Pressure Error}$$

Wherein: Kp, KD and KI are constants relating to proportional gain, derivative gain and integral gain, respectively.

It can be appreciated that the intake sensor 21 of FIG. 1 is used with a speed density system when computing airflow by measuring manifold pressure and air temperature. Alternatively, intake sensor 21 can represent an airflow meter so that airflow determination is done by using measurements from an air volume flow meter, air temperature and engine rpm or from an air mass flow meter and engine rpm.

Various modifications and variations will no doubt occur to those skilled in the arts to which this invention pertains. For example, a particular spark advance circuitry may be varied from that disclosed herein. This and all other variations which basically rely on the teachings through which this disclosure has advanced the art are properly considered within the scope of this invention.

I claim:

1. A method of controlling the idling speed of an internal combustion engine, said method comprising:

generating a speed error signal as a function of the difference between a desired engine idle speed and the actual engine idle speed;

generating a fuel pulse width command signal to control a fuel mass charge as a function of the speed error signal;

generating a throttle command signal as a function of the fuel mass charge to maintain a desired air to fuel ratio;

generating a spark advance;

phase compensating the speed error signal with respect to time;

generating a pressure error signal as the difference between a desired engine manifold pressure and an actual engine manifold pressure where desired engine manifold pressure is proportional to fuel charge and a function of air and coolant temperature;

phase compensating the pressure error signal with respect to time; and wherein generating a fuel pulse width command signal includes summing a first signal proportional to the phase compensated speed error signal and a second signal proportional to the time integral of the speed error; and generating a throttle command signal includes summing a first signal proportional to the phase compensated pressure error signal and a second signal proportional to the time integral of the pressure error.

2. A method as recited in claim 1 wherein the step of generating a spark advance includes generating a constant time delay for use in firing a spark plug in the next cylinder to be fired after the occurrence of top dead center in the last cylinder to be fired.

3. A method as recited in claim 1 further including the step of generating a signal proportional to the speed error to determine the pressure error.

4. A method as recited in claim 3 further comprising an additional phase compensation of the speed error signal to obtain the fuel pulse width command signal.

5. A method as recited in claim 3 further comprising an additional phase compensation of the speed error signal to produce a speed compensation signal for compensating the throttle command signal control signal.

6. A method as recited in claim 3 wherein the throttle command signal is adapted to control the air flow in a bypass valve around the throttle of the internal combustion engine.

7. A method of controlling the idling speed of an internal combustion engine, said method comprising:

generating a speed error signal as a function of the difference between a desired engine idle speed and the actual engine idle speed;

generating a fuel pulse width command to control fuel charge as a function of the speed error signal;

sensing actual intake manifold pressure;

generating a desired intake manifold pressure; and comparing actual and desired intake manifold pressure to get a difference which is used to generate a throttle position command signal to maintain a desired air to fuel ratio.

8. A method of controlling the idling speed of an internal combustion engine, said method comprising:

generating a speed error signal as a function of the difference between a desired engine idle speed and the actual engine idle speed;

generating a fuel pulse width command to control fuel charge as a function of the speed error signal;

sensing an actual air signal representative of an actual air flow in the throttle of the internal combustion engine;

generating a desired air signal representative of a desired air flow in the throttle of the internal combustion engine;

determining an air flow error signal which is the difference between the desired and the actual air signals; and generating a throttle command signal to control air flow in the throttle by using the air flow error signal.

9. A method as recited in claim 8 further comprising:

generating a phase compensated speed error signal to provide a speed effect compensation signal;

integrating the speed error signal;

generating a speed compensated pressure error signal as a function of the sum of the speed effect compensation signal, the integrated speed error signal and the actual air signal; and generating a throttle position command signal as a function of the speed compensated pressure error signal.

10. A method as recited in claim 9 further comprising the step of generating a spark control signal proportional to the speed error signal.

* * * * *